US006186236B1

(12) United States Patent
Cox

(10) Patent No.: US 6,186,236 B1
(45) Date of Patent: Feb. 13, 2001

(54) MULTI-ZONE SCREENLESS WELL FRACTURING METHOD AND APPARATUS

(75) Inventor: Morris W. Cox, Conroe, TX (US)

(73) Assignee: Halliburton Energy Services, Inc., Duncan, OK (US)

( * ) Notice: Under 35 U.S.C. 154(b), the term of this patent shall be extended for 0 days.

(21) Appl. No.: 09/400,332

(22) Filed: Sep. 21, 1999

(51) Int. Cl.[7] ..... E21B 43/26
(52) U.S. Cl. ..... 166/308; 166/177.5
(58) Field of Search ..... 166/280, 308, 166/177.5

(56) References Cited

U.S. PATENT DOCUMENTS

| | | | | |
|---|---|---|---|---|
| 3,090,436 | | 5/1963 | Briggs, Jr. | 166/63 |
| 3,289,762 | | 12/1966 | Schell et al. | 166/35 |
| 4,850,431 | | 7/1989 | Austin et al. | 166/308 |
| 5,265,678 | | 11/1993 | Grundmann | 166/308 |
| 5,361,843 | * | 11/1994 | Shy et al. | 166/297 |
| 5,398,763 | * | 3/1995 | Watson et al. | 166/382 |

* cited by examiner

*Primary Examiner*—William Neuder
(74) *Attorney, Agent, or Firm*—Robert A. Kent; Neal R. Kennedy

(57) ABSTRACT

A multi-zone screenless well fracturing method and apparatus which allows multiple zones in a well to be treated with one trip of the apparatus into the hole. The apparatus includes a tool string generally comprising a crossover, a packer below the crossover, and a concentric wash pipe extending below the packer. The crossover has a first portion in communication with a tubing string connected thereto and a second portion in communication with a well annulus above the packer. The first portion of the crossover is in communication with the inner wash pipe, and the second portion of the crossover is in communication with the outer wash pipe. The tool string is adapted to stab through a plurality of big bore casing packers which are positioned between adjacent zones. A method of fracturing multiple zones in a well while monitoring conditions at the zone is also disclosed.

20 Claims, 6 Drawing Sheets

MULTI-ZONE SCREENLESS WELL FRACTURING METHOD AND APPARATUS

BACKGROUND OF THE INVENTION

1. Field of the Invention

This invention relates to fracturing zones in a well, and more particularly, to a method and apparatus which allows multiple zones to be treated with one trip of the apparatus into the hole and which does not require hydraulic fracturing to be removed from each zone separately.

2. Description of the Prior Art

Hydraulic fracturing is the parting of a desired section of a well formation or zone by an application of hydraulic pressure. A fracture made in this manner may be extended from the wellbore by continued pumping. Extended distance will depend on several factors such as injection rates, formation or zone characteristics, fracturing fluid properties and injected volume of fluid.

Selected particles, added to the fracturing fluid, are transported into the fracture. These act as propping agents to hold the fracture open when the applied pressure is dissipated, thus leaving a channel of high flow capacity connected to the wellbore.

Initially, fracturing was applied primarily to old wells, but now a majority of the treatments performed are on new ones. Many new fields and field extensions have resulted from the application of this production stimulation technique.

Research dealing with theory, methods and materials has resulted in a wide selection of fracturing fluids, additives and equipment to satisfy the many well conditions encountered.

Procedures have been developed to enhance the possibility of obtaining additional fractures during a single treatment of a well. These techniques are known as Multi-Frac. They are especially applicable on wells having multiple pay zones or long producing zones.

Any of a variety of known fracturing fluids may be employed to produce a fracture in the well. Then, that fracture is bridged or sealed. Additional fracturing fluid is then diverted to other parts of the zone, or to other zones, to produce another fracture. Repetition of this procedure has made varied numbers of fractures, as indicated by surveys conducted before and after the treatment. Granular type materials of specific size and characteristics have proven to be very effective for quick sealing and bridging fractures, thus diverting the fluid to other portions of the formation. These are called bridging agents.

The assignee of the present invention has developed a multiple-stage fracturing system which reduces elapsed times between stages, thus allowing operators to reduce rig time, completion time and expense. The system utilizes one or more tubing or casing baffles positioned in the completion string between the zones to be stimulated. Each zone may be perforated, fractured and then temporarily isolated with a bridging ball while a shallower zone is being completed in like manner. Thus, a two-, three-, four- or five-stage fracturing operation usually can be completed in a semi-continuous manner allowing for the short time delay required to perforate each zone before treatment.

Casing or tubing baffles installed between zones in the completion string have graduated internal openings. Sealing balls are selected and mated with the baffles so that the smaller diameter balls or plugs will pass through the larger ID baffles that are installed at the more shallow depths. Some of the balls are of such density that they usually are expelled from the tubing with the flow of fluids and gas when the well is opened to test or production.

Other, more conventional methods utilize setting a plug below a zone and positioning a fracturing tool thereabove which includes a packer. The tool is then removed from the wellbore and another bridge plug positioned below the next higher zone, and the tool utilized again to fracture the formation. This can be repeated as many times as necessary. This system has the disadvantage of having to remove the fracturing tool at each formation so that another plug can be set.

The apparatus of the present invention solves these problems by providing a tool which can be utilized to fracture multiple zones without requiring that the tool be removed from each zone separately. Rather, it can be used to fracture multiple zones in a single trip.

SUMMARY OF THE INVENTION

The present invention includes both methods and apparatus for fracturing a plurality of zones in a well with a single trip of the apparatus into the wellbore. The invention is designed for use in a well having a plurality of vertically spaced formations or zones of interest.

A preferred embodiment of the method of fracturing a plurality of zones in a well comprises the steps of closing the well below a first one of the zones, positioning a first big bore casing packer between the first and second zones, positioning a second big bore casing packer above the second zone, and providing a tool assembly for carrying out the fracturing operation. The tool assembly comprises a tool packer, a crossover positioned above the tool packer, and a concentric wash pipe positioned below the tool packer and having an inner wash pipe portion and an outer wash pipe portion. The method further comprises positioning the tool assembly through the first and second big bore casing packers such that a lower end of the tool assembly is adjacent of the first zone, fracturing the first zone by pumping a fracturing fluid through the tool assembly and monitoring the progress of the fracturing operation at the surface, repositioning the tool assembly such that a lower end of the tool is adjacent to the second zone, and fracturing the second zone by pumping a fracturing fluid through the tool and monitoring progress of the fracturing operation of the surface. These steps may be completed for progressively higher zones.

The step of fracturing may comprise pumping fracturing fluid down the inner wash pipe and flowing fluid up the outer wash pipe such that well conditions at the zone being fractured may be monitored at the surface of the well. The apparatus may further comprise placing a sand cap on each zone after fracturing thereof.

The invention also includes an apparatus for fracturing a plurality of zones in a well. The apparatus comprises a big bore casing packer adapted for positioning in the well adjacent to one of the zones and a tool string adapted for positioning through the big bore casing packer. The tool string comprises a crossover having a first portion adapted for connection to, and communication with, a length of tubing and a second portion adapted for communication with a well annulus, a tool packer connected to the crossover adapted for sealing engagement with the wellbore below the crossover, and a concentric wash pipe extending below the tool packer. The packer has a central passageway in communication with the first portion of the crossover and the inner wash pipe, and an outer passageway in communication with the second portion of the crossover and the outer wash pipe. The concentric wash pipe comprises an inner wash pipe in communication with the first portion of the crossover and an outer wash pipe in communication with the second portion of the crossover.

The big bore casing packer has a bore adapted for receiving the tool string therethrough and is adapted for sealing engagement with an outer surface of the tool string when the big bore casing packer is positioned in an operating position sealingly engaged with the wellbore. This outer surface of the tool string is preferably an outer surface of the outer wash pipe.

In the preferred embodiment, the tool packer is a mechanical packer settable by rotation. However, other types of packers could be utilized.

The apparatus further comprises a screen attached to the outer wash pipe.

Numerous objects and advantages of the invention will become apparent as the following detailed description of the preferred embodiment in read in conjunction with the drawings which illustrate such embodiment.

DESCRIPTION OF THE PREFERRED EMBODIMENT

Figures 1, 2, 3, 4:
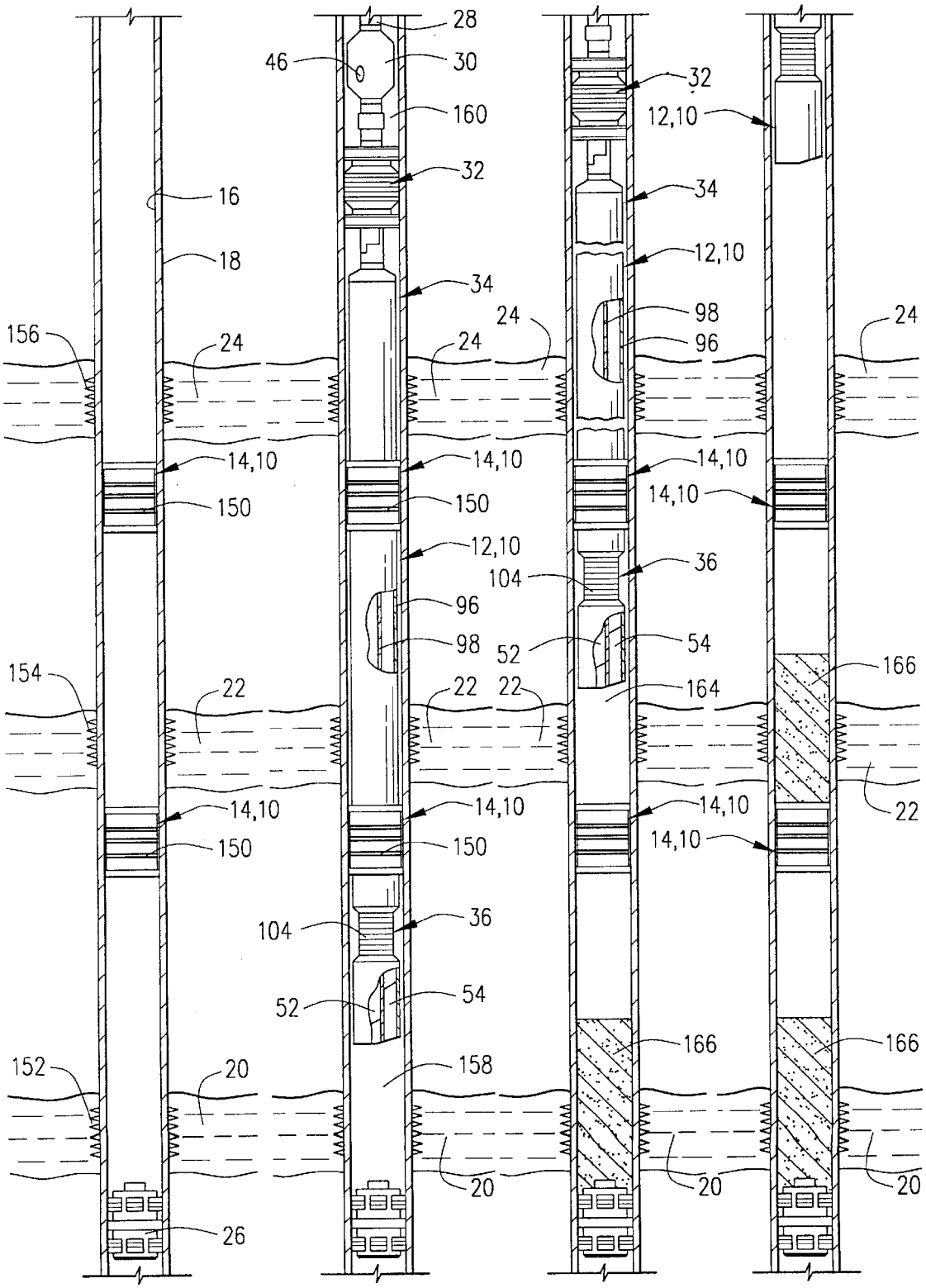
FIG. 1 illustrates a pair of big bore casing packers utilized in the multi-zone sreenless well fracturing apparatus of the present invention in an operating position in a well.
FIG. 2 shows the tool string of the invention positioned through the big bore casing packers in the well prior to fracturing a first, lowermost zone in the well.
FIG. 3 illustrates the tool string in position after fracturing the first zone in the well and prior to fracturing a second zone.
FIG. 4 illustrates the apparatus after fracturing the second zone in the well.

Referring now to the drawings, and more particularly to FIGS. 1 and 2, the multi-zone screenless well fracturing apparatus of the present invention is shown and generally designated by the numeral 10. Apparatus 10 generally includes a tool string portion or assembly 12 and a plurality of big bore packers 14.

Apparatus 10 is designed for use in a well 16 having a length of casing 18 therein. Typically, well 16 will have a plurality of well formations or zones of interest, such as designated by numerals 20, 22 and 24. The exact configuration of wells may vary, of course, and additional formations or zones may be present. The lower end of casing 16 is closed below lowermost zone 20 by conventional means, such as a bridge plug 26. A casing packer 14 is disposed between adjacent pairs of zones 20, 22 and 24. Casing packer 14 is of a known type also referred to as a big bore packer. Additional big bore packers 14 may be used for additional zones. Tool 12 is adapted for connection to a tubing string 28 by which it is run in and out of well 16 and disposed through big bore packers 14.

Generally, tool 12 comprises a crossover 30 connected at the lower end of tubing string 28, a tool packer 32 disposed below crossover 30 and adapted for sealing engagement with casing 18, a concentric wash pipe 34 extending downwardly from tool packer 32, and a screen sub 36 at the lower end of concentric wash pipe 34.

FIG. 2 shows apparatus 10 in position for fracturing first, lowermost zone 20. FIGS. 3 and 4 illustrate the operation of apparatus 10, as will be further described herein.

Referring now to FIGS. 5A–5J, the details of apparatus 10 will be discussed.

Figure 5A:
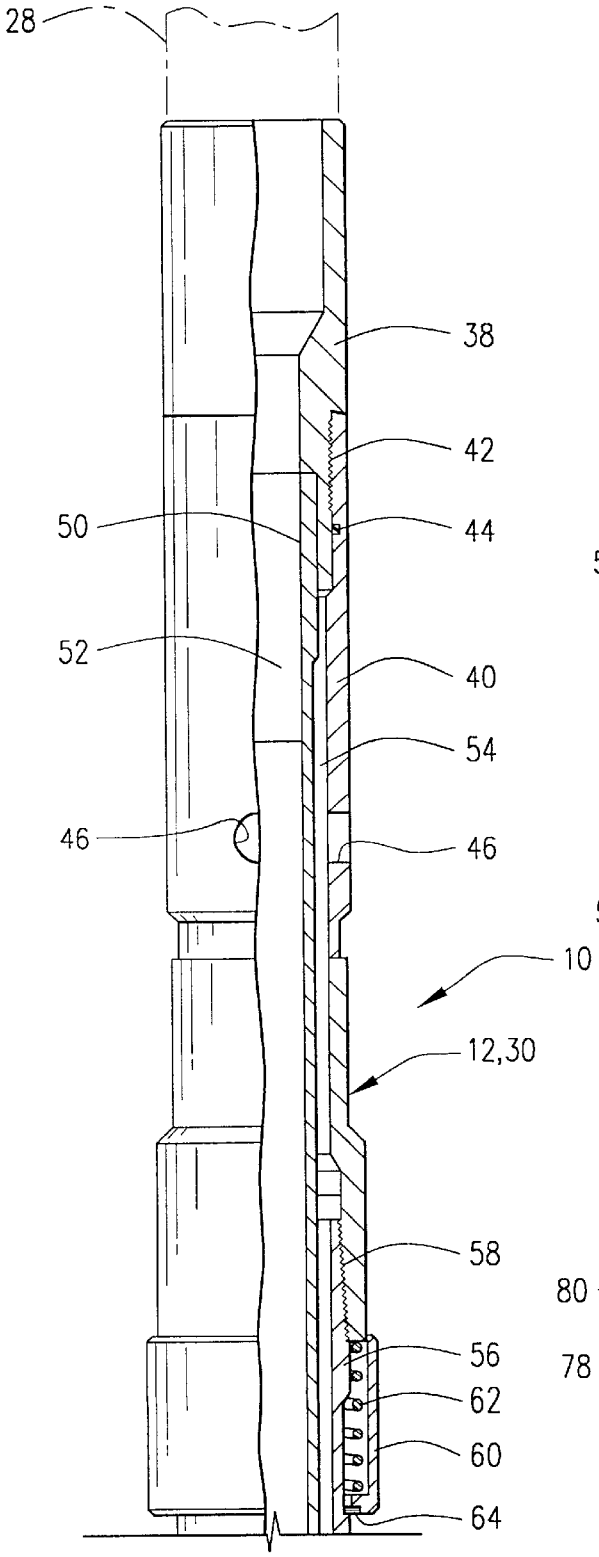
FIGS. 5A–5J show details of the apparatus.

First looking at FIG. 5A, at the upper end of crossover 30 is a top sub 38 adapted for connection to tubing string 28. An outer ported seal mandrel 40 is attached to top sub 38 at threaded connection 42. A seal 44 provides sealing engagement therebetween. Outer ported seal mandrel 40 defines a plurality of radially oriented ports 46 therein which are in communication with a well annulus 160 as further described herein.

An inner ported seal mandrel 48 is disposed concentrically within outer ported seal mandrel 40, and an upper end of inner port seal mandrel 48 is positioned in a bore 50 in top sub 38. It will thus be seen that a central opening 52 is defined through top sub 38 and inner ported seal mandrel 48 which is in communication with tubing string 28.

An upper end of an annular passageway 54 is defined between inner ported seal mandrel 48 and outer ported seal mandrel 40. It will be seen that annular passageway 54 is in communication with ports 46 in outer ported seal mandrel 40.

The lower end of outer ported seal mandrel 40 is attached to a packer mandrel 56 at threaded connection 58.

A spring housing 60 is slidably disposed around packer mandrel 56 and outer ported seal mandrel 40 and is biased downwardly by a spring 62. Downward movement of spring housing 60 is limited by a retainer ring 64 engaged with packer mandrel 56.

Figure 5B:
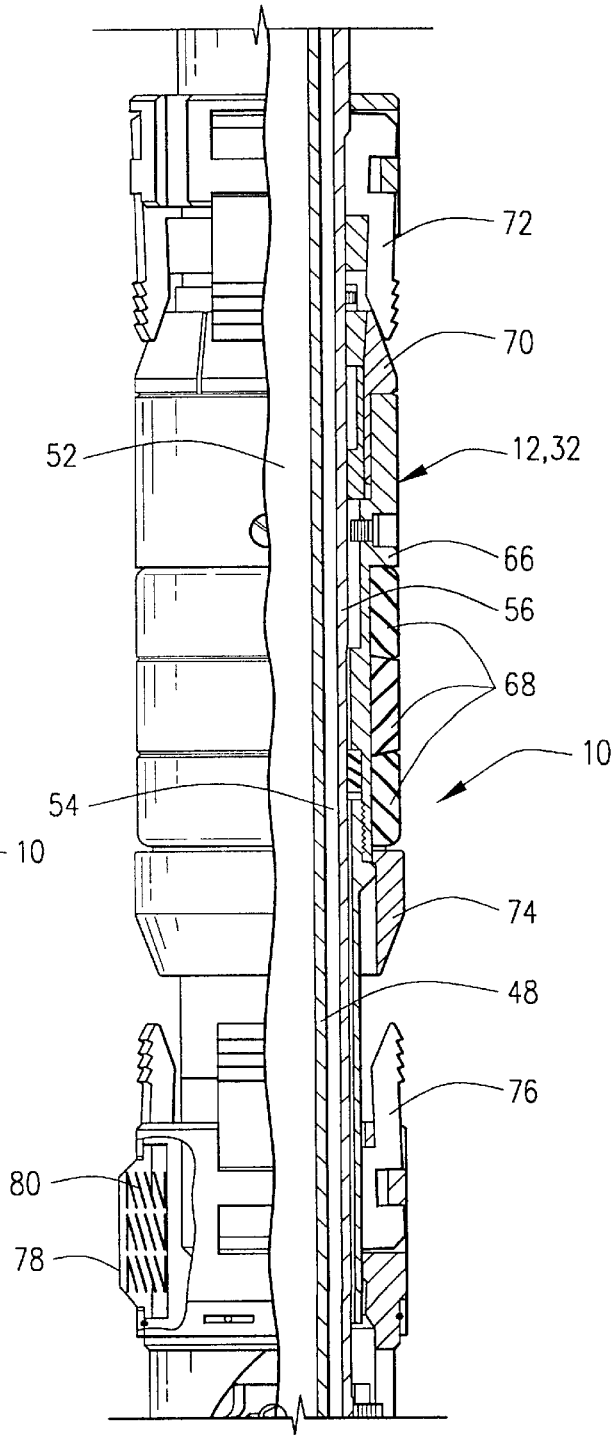

Referring now to FIG. 5B, packer mandrel 56 is a centrally located component of tool packer 32. In the preferred embodiment, tool packer 32 is shown as an Otis PermaLach®, a known mechanical packer set by rotation, but the invention is not intended to be limited to any particular packer configuration. For example, the invention could also be adapted for use with other squeeze packers and inflatable packers.

Tool packer 32 has a packer seal mandrel 66 on which are disposed a plurality of packer elements 68. Above packer seal mandrel 66 is an upper wedge 70 adapted for engagement with a plurality of upper slips 72.

Below packer seal mandrel 66 is a lower wedge 74 adapted for engagement with a plurality of lower slips 76. A plurality of spring-loaded drag blocks 78 are disposed below slips 76. Drag blocks 78 are biased radially outwardly by a plurality of springs 80. Drag blocks 78 engage casing 18 to prevent the lower portion of tool packer 32, including lower slips 76, from rotating with respect to the upper portion of the tool packer when tubing string 28 is rotated to set the packer, as will be further described herein.

Figure 5C:
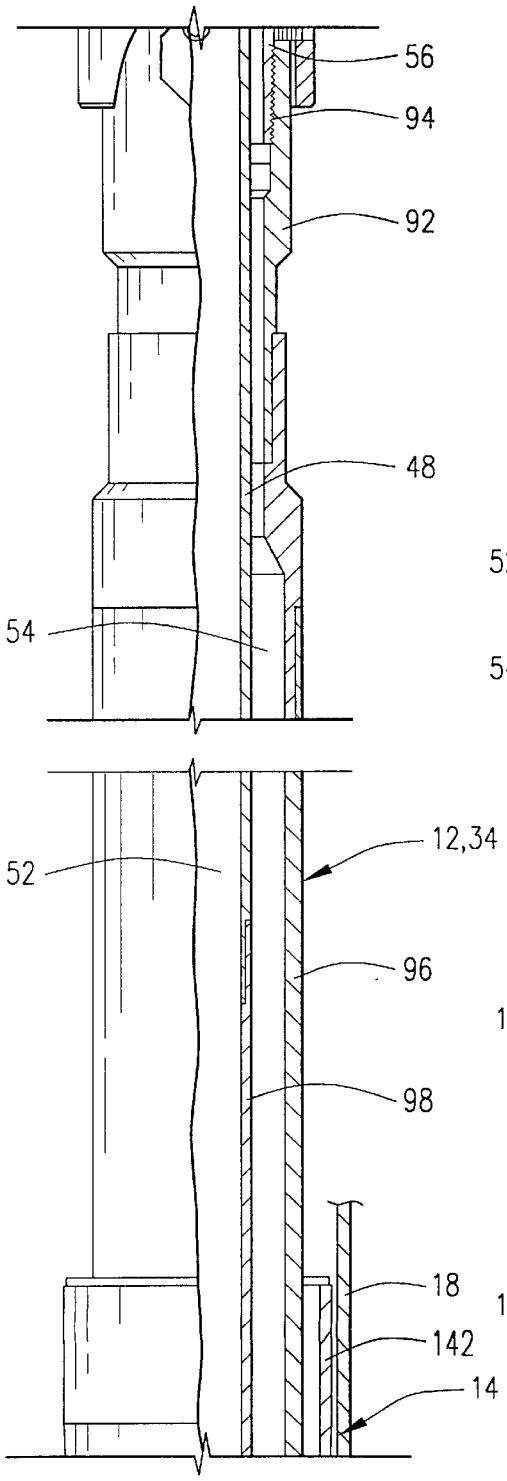

Referring now to FIG. 5C, the lower end of packer mandrel 56 is attached to an outer wash pipe adapter 92 at threaded connection 94. Outer wash pipe adapter 92 is attached to a downwardly extending outer wash pipe 96 in any manner known in the art, such as by a threaded connection or welding. Outer wash pipe 96 is an outer portion of concentric wash pipe 34. Similarly, the lower end of inner ported seal mandrel 48 is attached to an inner wash pipe 98 which is an inner portion of concentric wash pipe 34. Central opening 52 continues downwardly through inner wash pipe 98 and annular passageway 54 continues downwardly between inner wash pipe 98 and outer wash pipe 96. See FIGS. 5D–5G.

Figure 5D:
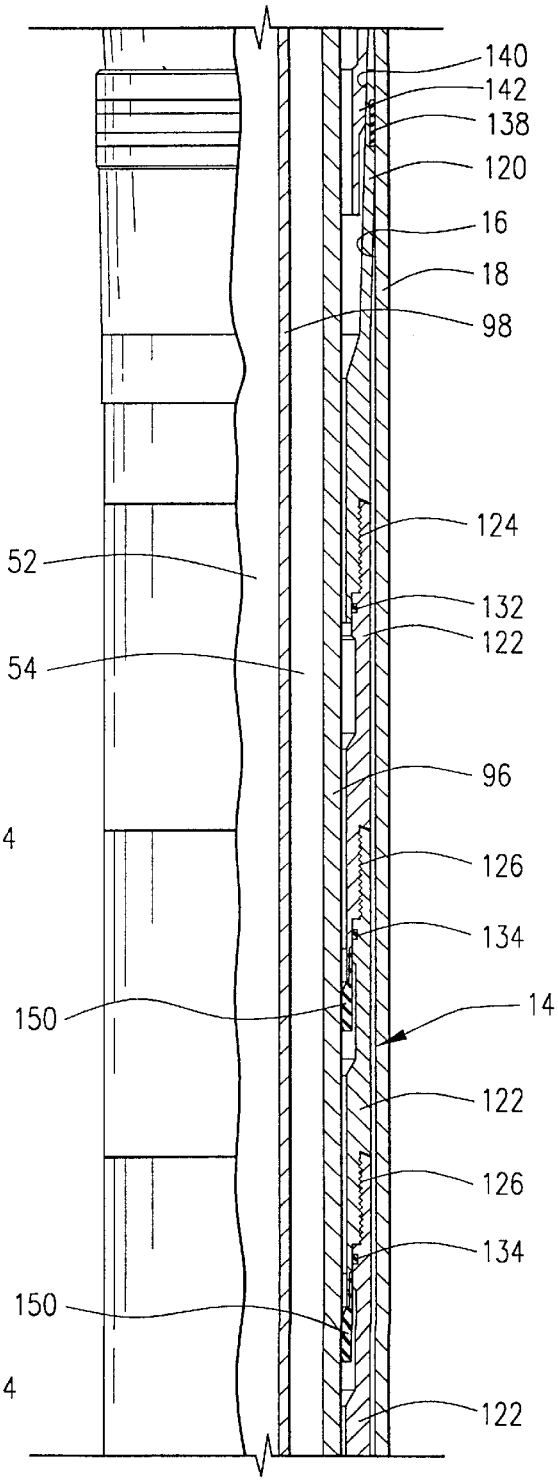
Figures 5E, 5F:
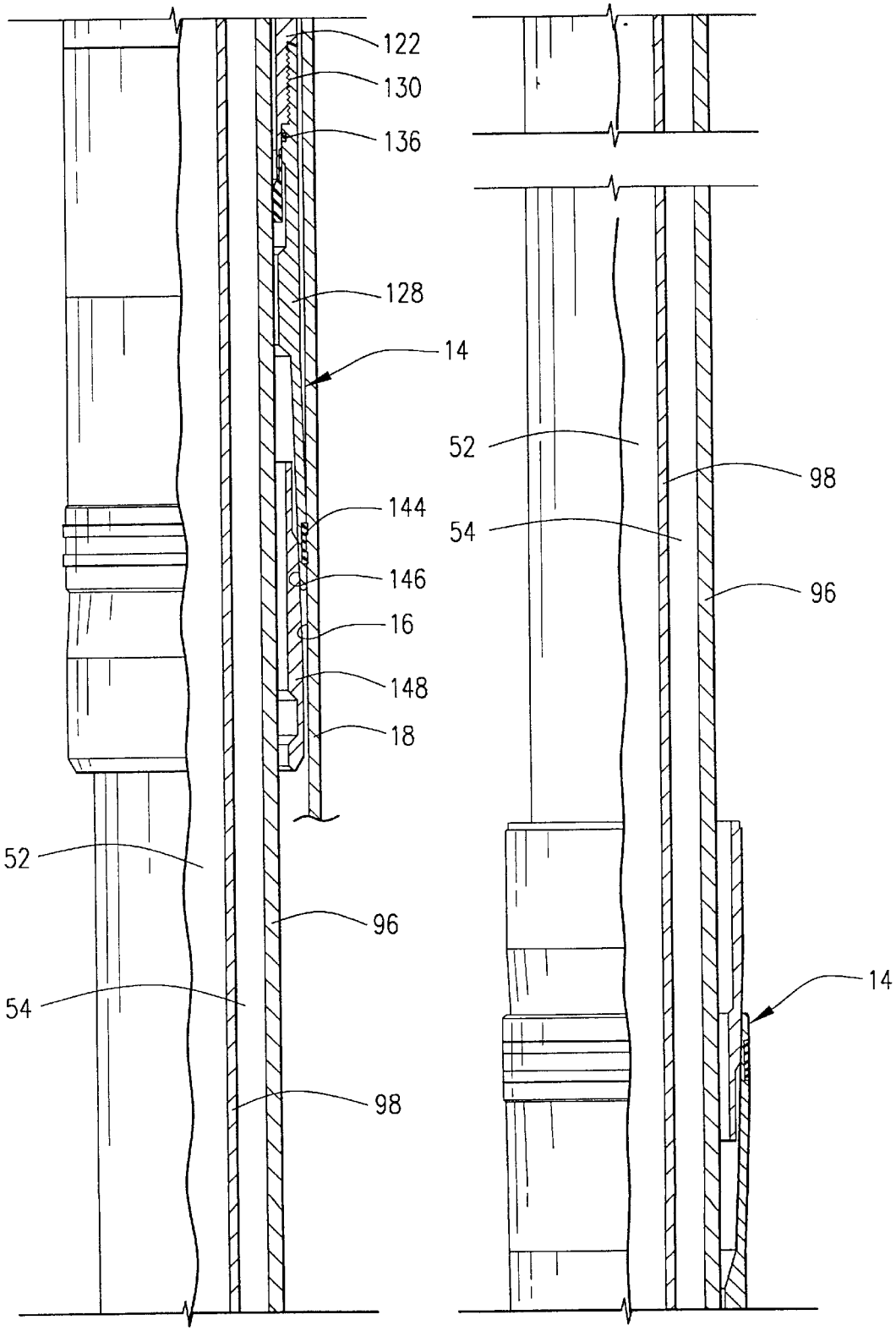
Figure 5G:
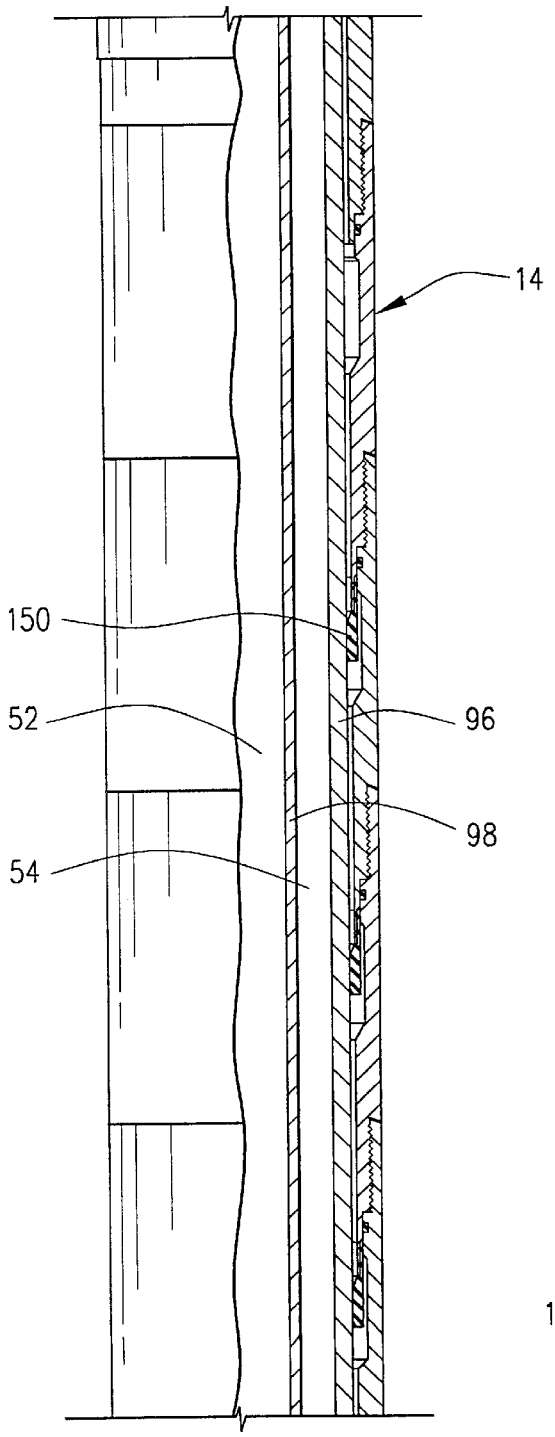
Figure 5H:
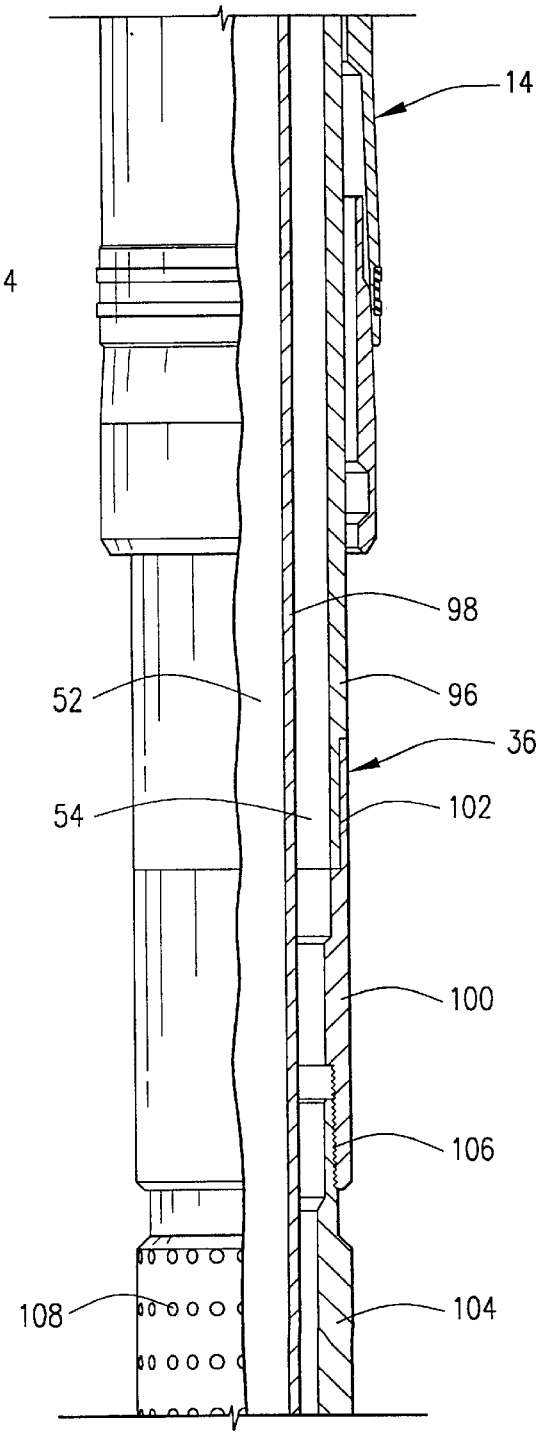

Referring now to FIG. 5H, the lower end of outer wash pipe 96 is attached to a screen adapter 100 at the upper end of screen sub 36 at threaded connection 102. The lower end of screen adapter 100 is attached to a screen 104 at threaded connection 106. Preferably, but not by way of limitation, screen 104 is a Purolator Poroplus® screen having a plurality of openings 108 defined therein.

Figure 5I:
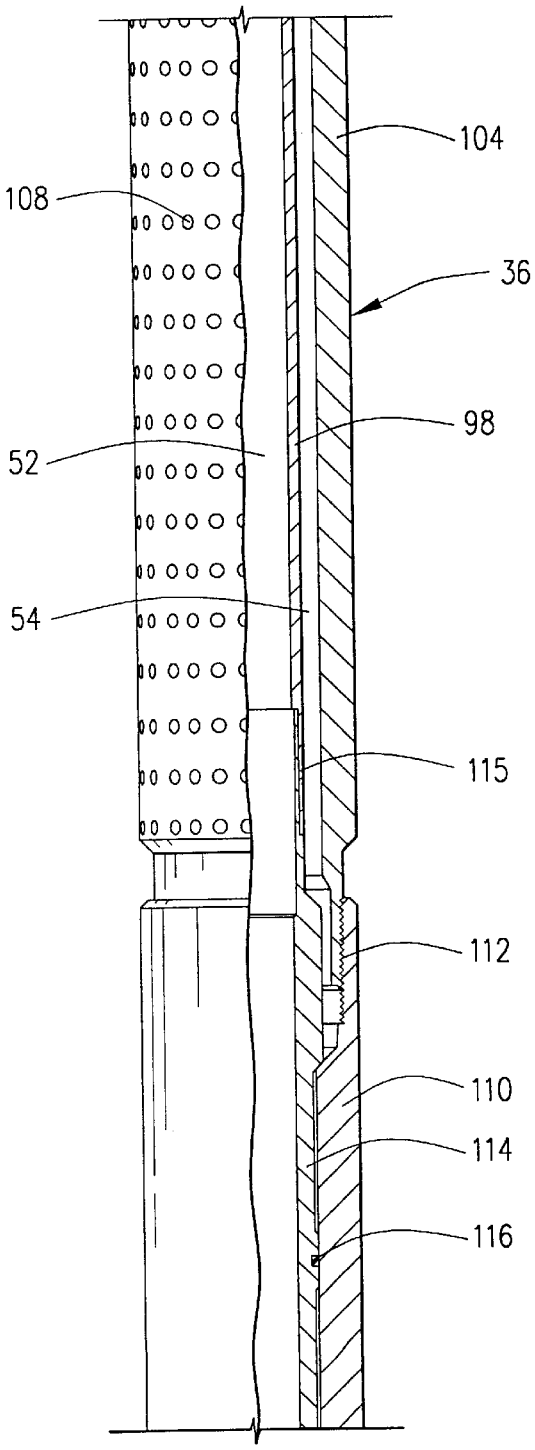
Figure 5J:
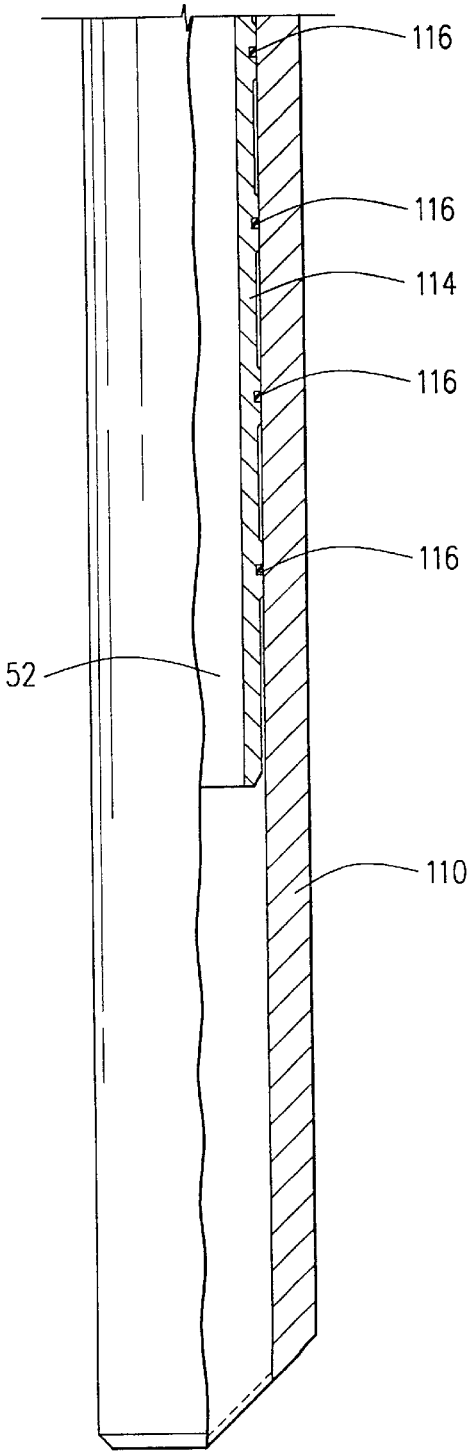

As seen in FIG. 5I, the lower end of screen 104 is attached to a return flow sub at threaded connection 112.

The lower end of inner wash pipe 98 is attached to a lower seal sub 114 at threaded connection 115. The lower end of seal sub 114 fits closely within return flow sub 110, and a plurality of seals 116 provide sealing engagement therebetween. See also FIG. 5J.

It will be seen that central opening 52 thus exits at the lower end of return flow sub 110. The lower end of annular passageway 54 is closed by seals 116. Openings 108 in screen 104 provide communication with annular passageway 54 and the portion of well 16 adjacent thereto.

The details of a big bore casing packer 14 are shown in FIGS. 5C–5E, and another is shown in FIGS. 5F–5H. Each big bore packer 14 has an outer housing 118 which includes an upper seal mandrel 120 attached to a housing mandrel 122 at threaded, connection 124. A plurality of housing mandrels 122 may be used and connected together at threaded connections 126. A lower seal mandrel 128 is connected to the lowermost housing mandrel 122 at threaded connection 130. A seal 132 provides sealing engagement between upper seal mandrel 120 and the adjacent housing mandrel 122. Seals 134 provide sealing engagement between adjacent housing mandrels 122. A seal 136 provides sealing engagement between lower seal mandrel 128 and the adjacent housing mandrel 122.

An outer packer seal 138 is disposed on the upper end of upper seal mandrel 120 and is adapted for sealing engagement with bore 116 of casing 18. Upper seal mandrel 120 has a tapered bore 140 therein which is adapted for engagement by an upper wedge 142.

Another outer packer seal 144 is disposed on the lower end of lower seal mandrel 128 and also adapted for sealing engagement with bore 116 in casing 18. Lower seal mandrel 128 has a tapered bore 146 therein adapted for engagement by a lower wedge 148. A plurality of inner packer sealing elements 150 are positioned in big bore casing packer 14 and are adapted for sealing engagement with the outer portion of outer wash pipe 96. Other big bore packers 14, such as the one in FIGS. 5F–5H, are of identical construction.

Operation of the Invention

Referring again to FIGS. 1–4, the operation of apparatus 10 and the method of the invention for fracturing a well formation or zone of interest will be discussed.

FIG. 1 illustrates casing 18 disposed in well 16. As already mentioned, well 16 has a plurality of formations or zones, such as indicated by numerals 20, 22 and 24. Each zone 20, 22, 24 is perforated in a known manner so that the zones can be fractured and produced through perforations 152, 154, 156 respectively.

The lower end of casing 18 is closed off below lowermost zone 20 by bridge plug 26 or similar means. A big bore packer 14 is disposed between adjacent zones. That is, a big bore packer 14 is disposed between adjacent zones 20 and 22, and another big bore packer 14 is disposed between adjacent zones 22 and 24. Additional big bore packers 14 may be utilized for additional zones.

Each big bore packer 14 is set in a manner known in the art by a setting tool which causes upper wedge 142 to be forced relatively toward tapered bore 140 of upper seal mandrel 120 such that the upper seal mandrel is expanded out against bore 116 in casing 18 and outer packer seal 138 sealingly engaged with the casing. Similarly, during the setting operation, lower wedge 148 is forced relatively toward tapered bore 146 in lower seal mandrel 128 such that outer packer seal 144 is placed in sealing engagement with the casing.

When it is desired to fracture any of zones 20, 22, 24, tool 12 is run into well 16 and stabbed through big bore packers 14. Tool 12 is initially positioned so that screen sub 36 is disposed below lowermost big bore packer 14, as seen in FIG. 2. The outside diameter of outer wash pipe 96 is sized such that it fits closely within big bore packers 14 and is sealingly engaged by sealing elements 150 in the big bore packers. In this position, it will be seen that annular passageway 54 and central opening 52 in tool 12 are in communication with a portion 118 of well 16 adjacent to zone 20. Thus, a portion 158 of well 16 adjacent to zone 20 is sealingly closed above zone 20 by the lowermost big bore packer 14.

Setting packer 32 is performed in a conventional manner by rotating tubing string 28. Drag blocks 78 insure that the lower portion of tool packer 32 does not rotate. This rotation causes relative longitudinal movement between upper wedge 70 and upper slips 72, forcing the upper slips to pivot outwardly into gripping engagement with casing 18. Upper slips 72 are also moved into engagement with spring housing 60, deflecting spring 62. Spring 62 acts to bias spring housing 60 against upper slips 72 keeping them in their set position. Packer elements 68 are compressed longitudinally so that they are squeezed radially outwardly into sealing engagement with casing 18. Also, the rotation results in relative movement between lower wedge 74 and lower slips 76 such that lower slips 76 are pivoted outwardly into gripping engagement with casing 18. Thus, packer 32 is locked and sealed against bore 116 in casing 18.

As seen in FIG. 2, a well annulus 160 is formed between tool 12 and tubing string 28 above the set packer 32. It will be seen by those skilled in the art that well annulus 160 is in communication with annular passageway 54 in tool 12 through ports 46 in crossover 30. That is, well annulus 160 is placed in communication with lower portion 158 of well 16 when in the position shown in FIG. 2. In this way, bottom hole pressure at zone 20 may be communicated to the wellhead through annular passageway 54 and well annulus 160. This allows the operator to monitor the progress of the fracturing operation.

Fracturing fluid may be pumped downwardly through tubing string 28 and central opening 52 of tool 12 so that zone 20 is fractured in a known manner.

When the fracturing of zone 20 is complete, excess proppant is reverse-circulated out of well 16 by pumping fluid down well annulus 160 and annular passageway 54.

A sand plug 164 (see FIG. 3) is preferably spotted on fractured zone 20 to isolate the zone initially. The amount of sand may be controlled by pumping downwardly through central opening 52 or reverse circulating to remove excess sand.

Tool packer 32 is then released so that tool 12 may be repositioned between zones 22 and 24, as seen in FIG. 3. In this position, screen 104 is disposed between lowermost big bore packer 14 and the big bore packer immediately above. Another portion 164 of well 16 is thus formed adjacent to zone 22 and isolated from zone 20 by sand cap 164. At this point, portion 164 of well 16 is in communication with well annulus 160. Zone 22 may be fractured in a manner similar to that for zone 20, after which a sand cap 166 may be placed over zone 22 and tool 12 moved to another position in well 16 as seen in FIG. 4.

Zone 24 may then be fractured in substantially the same manner as well as any other zones thereabove.

After all zones are fractured, the sand caps, such as sand caps 164 and 166, may be drilled out and production carried out from the fractured zones in a manner known in the art.

It will be seen, therefore, that the multi-zone screenless well fracturing apparatus and method of the present invention are well adapted to carry out the ends and advantages mentioned, as well as those inherent therein. While a preferred embodiment of the invention has been described herein, numerous changes in the arrangement and construction of parts of the apparatus and in steps in the method may be made by those skilled in the art. All such changes are encompassed within the scope and spirit of the appended claims.

What is claimed is:

1. A method of fracturing a plurality of zones in a well comprising the steps of:

(a) closing the well below a first one of the zones;

(b) positioning a first casing packer between the first zone and a second zone;

(c) positioning a second casing packer above the second zone;

(d) providing a tool assembly comprising:

a tool packer;

a crossover positioned above said tool packer; and a concentric wash pipe positioned below said tool packer and having an inner wash pipe portion and an outer wash pipe portion;

(e) positioning said tool assembly through said first and second casing packers such that a lower end of said tool assembly is adjacent to the first zone;

(f) fracturing the first zone by pumping fracturing fluid through said tool assembly and monitoring progress of the fracturing operation at the surface;

(g) repositioning said tool assembly such that a lower end of said tool assembly is adjacent to the second zone; and (h) fracturing the second zone by pumping fracturing fluid through said tool assembly and monitoring progress of the fracturing operation at the surface.

2. The method of claim 1 wherein:

step (g) comprises placing a sand cap on the first zone after fracturing thereof; and step (i) comprises placing a sand cap on the second zone after fracturing thereof.

3. The method of claim 1 further comprising repeating steps (e) through (h) for progressively higher zones.

4. The method of claim 1 wherein steps (f) and (h) comprise pumping said fracturing fluid down said inner wash pipe.

5. The method of claim 4 further comprising, during steps (f) and (h), flowing fluid up said outer wash pipe such that well conditions at the zone being fractured may be monitored at a surface of the well.

6. The method of claim 1 wherein steps (e) and (g) comprise sealing between said casing packer and said tool assembly.

7. A method of fracturing multiple zones in a well comprising the steps of:

(a) closing the well below a lower one of the zones;

(b) positioning a casing packer between adjacent zones;

(c) providing a downhole tool comprising:

a tubing string;

a crossover attached to said tubing string and having a central opening in communication with said tubing string and an outer portion in communication with a well annulus;

a tool packer attached to said crossover; and a concentric wash pipe disposed below said tool packer and having an inner wash pipe portion in communication with said central opening in said crossover and an outer wash pipe portion in communication with said outer portion of said crossover;

(d) positioning said downhole tool through said casing packer such that a lower end of said tool is below said casing packer;

(e) setting said tool packer; and (f) fracturing a zone below said casing packer by pumping fracturing fluid downwardly through said tubing string, said central opening of said crossover, said tool packer and said inner wash pipe portion and monitoring the fracturing operation by flowing fluid upwardly through said outer wash pipe portion, said tool packer, said outer portion of said crossover and the well annulus.

8. The method of claim 7 further comprising:

(g) placing a sand cap on the zone below said casing packer.

9. The method of claim 7 further comprising the steps of:

(g) unsetting said tool packer;

(h) repositioning said downhole tool such that said lower end thereof is above said casing packer;

(i) resetting said tool packer; and (j) fracturing another zone above said casing packer by pumping fracturing fluid downwardly through said tubing string, said central opening of said crossover, said packer and said inner wash pipe portion and monitoring the fracturing operation by flowing fluid upwardly through said outer wash pipe portion, said tool packer, said outer portion of said crossover and the well annulus.

10. The method of claim 9 further comprising, between steps (f) and (g), the step of:

placing a sand cap on the formation above said casing packer.

11. The method of claim 9 wherein:

step (b) comprises positioning a plurality of casing packers between adjacent pairs of zones; and further comprising repeating steps (g) through (j) for at least one additional zone and a corresponding casing packer thereabove which is above the other two mentioned zones.

12. The method of claim 7 wherein step (d) comprises sealing between said casing packer and said downhole tool.

13. An apparatus for fracturing a plurality of zones in a well, said apparatus comprising:

a casing packer adapted for positioning in the well adjacent to one of the zones;

a tool string positionable through said casing packer and comprising:

a crossover having a first portion adapted for connection to, and communication with, a length of tubing and a second portion adapted for communication with a well annulus;

a tool packer connected to said crossover adapted for sealing engagement with a wellbore below said crossover; and a concentric wash pipe extending below said tool packer and comprising:

an inner wash pipe in communication with said first portion of said crossover; and an outer wash pipe in communication with said second portion of said crossover.

14. The apparatus of claim 13 wherein said casing packer defines a bore therein adapted for receiving said tool string therethrough.

15. The apparatus of claim 13 wherein said casing packer comprises a seal for sealing on an outer surface of the tool string.

16. The apparatus of claim 15 wherein said outer surface of said tool string is an outer surface of said wash pipe.

17. The apparatus of claim 13 wherein said tool packer is a mechanical packer settable by rotation.

18. The apparatus of claim 13 further comprising a screen attached to said outer wash pipe and in communication therewith.

19. The apparatus of claim 13 wherein said inner wash pipe opens at a lower end thereof into the well.

20. The apparatus of claim 13 wherein:

said packer defines a central opening therethrough in communication with said first portion of said crossover and said inner wash pipe; and said packer defines a passageway therethrough in communication with said second portion of said crossover and said outer wash pipe.

* * * * *